US009298170B1

(12) United States Patent
Fang

(10) Patent No.: US 9,298,170 B1
(45) Date of Patent: Mar. 29, 2016

(54) WATCH CAPABLE OF AUTOMATICALLY TURNING ON BACKLIGHT AND RELATED METHOD

(71) Applicant: MITAC INTERNATIONAL CORP., Taoyuan (TW)

(72) Inventor: Yu-Siang Fang, Taoyuan (TW)

(73) Assignee: MITAC INTERNATIONAL CORP., Taoyuan (TW)

( * ) Notice: Subject to any disclaimer, the term of this patent is extended or adjusted under 35 U.S.C. 154(b) by 0 days.

(21) Appl. No.: 14/847,870

(22) Filed: Sep. 8, 2015

(30) Foreign Application Priority Data

Sep. 15, 2014 (TW) ..... 103131764 A

(51) Int. Cl.
*G04G 21/04* (2013.01)
*G04C 17/02* (2006.01)

(52) U.S. Cl.
CPC ..... *G04G 21/04* (2013.01); *G04C 17/02* (2013.01)

(58) Field of Classification Search
CPC ... G04G 9/0017; G04G 9/0041; G04G 21/04; G04C 17/02
See application file for complete search history.

(56) References Cited

U.S. PATENT DOCUMENTS 5,194,064 A * 3/1993 Simpson ..... B31B 1/25 493/402
6,204,752 B1 * 3/2001 Kishimoto ..... B62J 99/00 340/432
7,778,118 B2 * 8/2010 Lyons ..... G04G 21/04 368/69
7,817,500 B2 * 10/2010 Chan ..... G04G 13/021 310/318
9,173,275 B2 * 10/2015 Go ..... G04G 11/00
2007/0217290 A1 * 9/2007 Rock ..... H05B 37/0281 368/12

* cited by examiner

*Primary Examiner* — Sean Kayes
(74) *Attorney, Agent, or Firm* — Rabin & Berdo, P.C.

(57) ABSTRACT

A watch capable of automatically turning on a backlight and a related method includes: providing a watch and one or more wearable device both supporting a wireless communication protocol, establishing a communication between the watch and the wearable device via the wireless communication protocol, measuring a signal strength related to the communication, determining whether a distance condition is satisfied based on the signal strength, and turning on a backlight of the watch when the distance condition is satisfied.

8 Claims, 5 Drawing Sheets

WATCH CAPABLE OF AUTOMATICALLY TURNING ON BACKLIGHT AND RELATED METHOD

CROSS-REFERENCES TO RELATED APPLICATIONS

This non-provisional application claims priority under 35 U.S.C. §119(a) on Patent Application No. 103131764 filed in Taiwan, R.O.C. on Sep. 15, 2014, the entire contents of which are hereby incorporated by reference.

BACKGROUND

1. Technical Field

The instant disclosure relates to a method of turning on a backlight, and more particularly, to a watch capable of automatically turning on a backlight and a related method.

2. Related Art

Sensors are set in watches by certain manufacturer for creating better user experiences. When a specific movement is detected by said sensors, backlights of the watches will be automatically turned on. Accordingly, the inconvenience that users have to manually turn on the backlights could be avoided. For example, the backlights can be automatically turned on while users are swinging the watches.

The backlights of the watches are sometimes automatically turned on because of the detection of a user's movement even though the user does not intend to read the watch. In these false detection circumstances, it causes electricity wasting.

SUMMARY

How to avoid false detection causing the backlights to be automatically and unexpectedly turned on is an issue sought to be solved by the instant disclosure. To address the above issues, the instant disclosure provides a watch capable of automatically turning on a backlight and a related method. As a result, the issue of prior arts that false detection causes the backlights to be automatically and unexpectedly turned on can be solved.

According to an embodiment of the instant disclosure, a method of automatically turning on a backlight of a watch comprises: providing a watch and at least a wearable device both supporting a wireless communication protocol, establishing a communication between the watch and the wearable device via the wireless communication protocol, measuring a signal strength related to the communication, determining whether a distance condition is satisfied based on the signal strength, and turning on a backlight of the watch when the distance condition is satisfied.

According to an embodiment of the instant disclosure, the watch determines whether to turn on the backlight further based on a movement condition, and the watch turns on the backlight when the distance condition and the movement condition are both satisfied. Therefore, the backlight of the watch can be automatically turned on more precisely when users want to read the watch. Hence, it reduces consumption of electric power.

The movement condition is related with measurement data of an accelerometer (e.g., a G-sensor) of the watch.

According to an embodiment of the instant disclosure, the method further comprises: determining, when one of the distance condition and movement condition is satisfied, whether or not the other one is satisfied; if the other one is not satisfied, detecting whether the backlight of the watch is manually turned on by a user within a predetermined time; and correcting the unsatisfied distance condition or the unsatisfied movement condition if the backlight of the watch is manually turned on by a user within the predetermined time; wherein, the distance condition is corrected if the distance condition is unsatisfied; or the movement condition is corrected if the movement condition is unsatisfied. The method thereby includes a self-learning capability such that the timing of automatically turning on the backlight is closer to users' need.

According to another embodiment of the instant disclosure, a watch capable of automatically turning on a backlight comprises a backlight unit, a wireless communication unit, and a controller. The wireless communication unit is signally connected to at least a wearable device to establish a communication therebetween for measuring a signal strength related to the communication. The controller is coupled to the wireless communication unit and the backlight unit. The controller determines whether a distance condition is satisfied based on the signal strength and, if so, the controller turns on the backlight unit.

Herein, the watch further comprises an accelerometer coupled to the controller. The controller determines whether a movement condition is satisfied based on measurement data of the accelerometer. The backlight unit will be turned on when the movement condition and distance condition are both satisfied.

Herein, the controller determines, when one of the distance condition and movement condition is satisfied, whether the other one is satisfied; if not, detects whether the backlight of the watch is manually turned on by a user within a predetermined time, and, if so, corrects the unsatisfied distance condition or the unsatisfied movement condition.

According to the watch capable of automatically turning on the backlight and the related method, the backlight can be automatically turned on more precisely when user want to read the watch, and it reduces consumption of electric power. The timing of automatically turning on the backlight can be closer to users' need by the method of self-correcting and determining the conditions.

The features of the instant disclosure will no doubt become understandable to those of ordinary skill in the art after reading the following detailed description of the preferred embodiment that is illustrated in the various figures and drawings.

DETAILED DESCRIPTION

Figure 1:
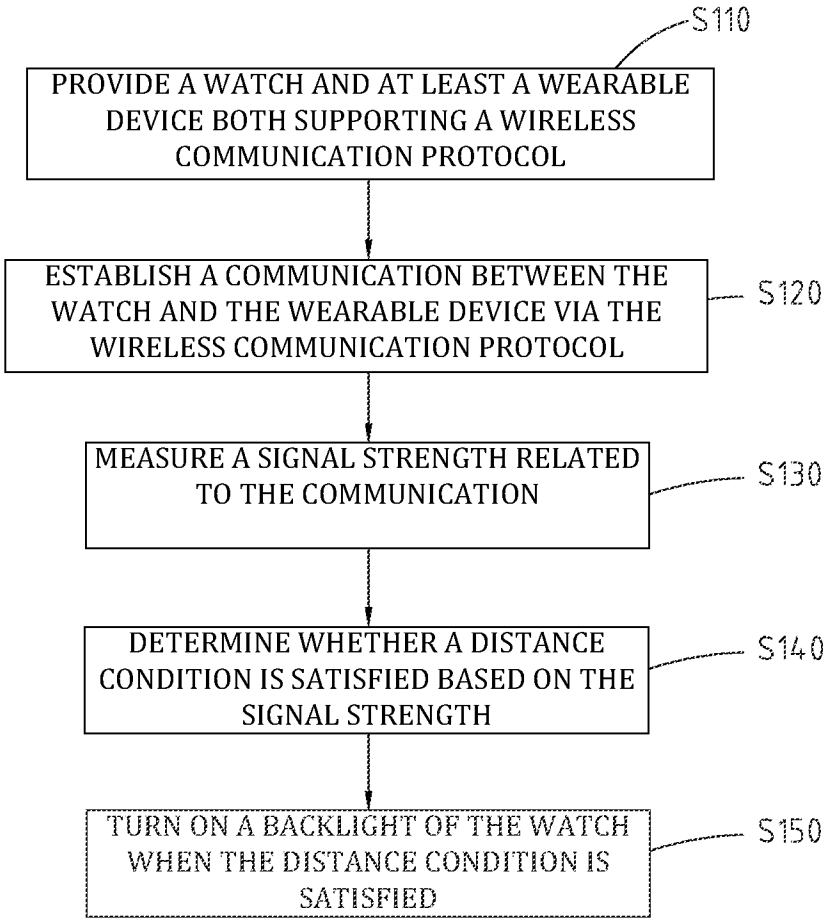
FIG. 1 illustrates a flow chart of a method of automatically turning on a backlight of a watch according to an embodiment of the instant disclosure.

FIG. 1 illustrates a flow chart of a method of automatically turning on a backlight of a watch according to an embodiment of the instant disclosure. First, as shown in FIG. 1, the step S110 is to provide a watch 200 and wearable device 300 both supporting a wireless communication protocol.

Figure 2:
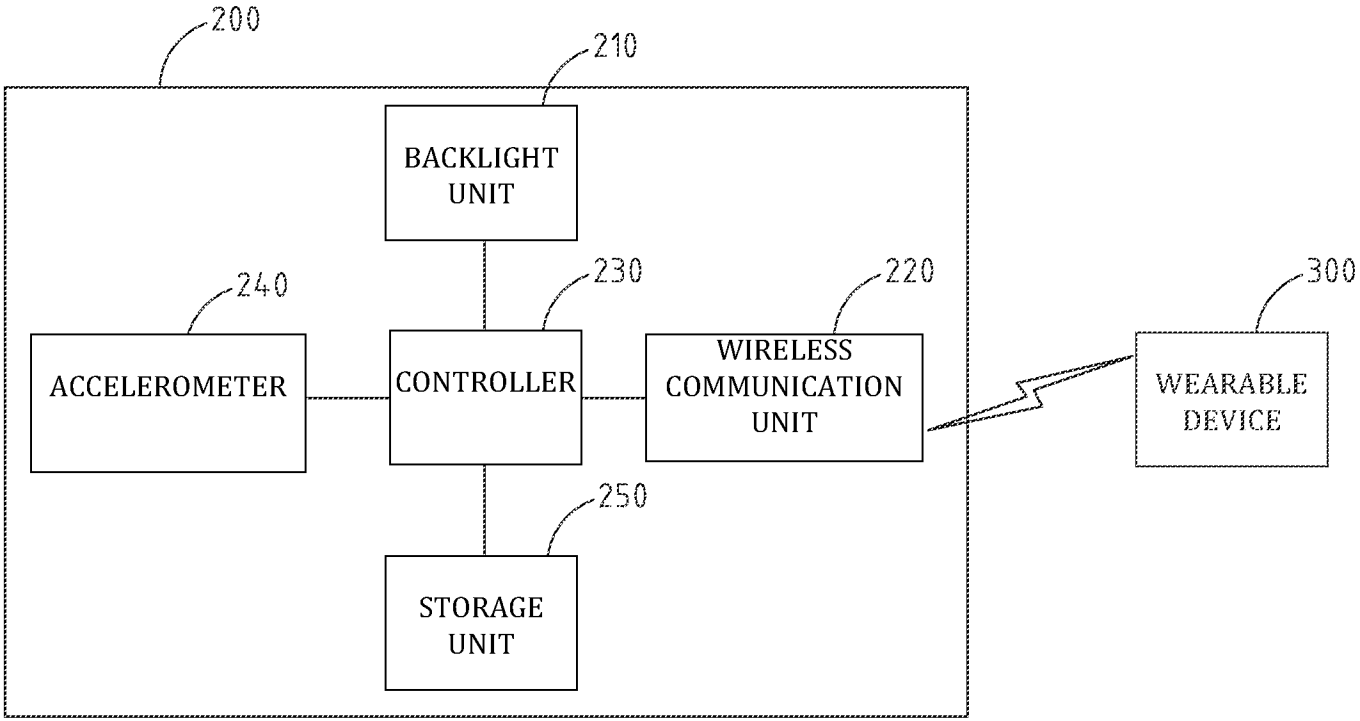
FIG. 2 illustrates a block diagram of the watch and a wearable device according to an embodiment of the instant disclosure.

FIG. 2 illustrates a block diagram of the watch 200 and the wearable device 300 according to an embodiment of the instant disclosure. The watch 200 capable of automatically turning on a backlight includes, as shown in FIG. 2, a backlight unit 210, a wireless communication unit 220, a controller 230, an accelerometer 240, and a storage unit 250. The controller 230, such as a microcontroller, is coupled to the backlight unit 210, the wireless communication unit 220, the accelerometer 240 and the storage unit 250. The wireless communication unit 220 supports wireless communication protocols such as Bluetooth, Zigbee, ANT+, or wireless network (e.g., IEEE 802.11). The wireless communication unit 220 includes a communication chip, an antenna, and peripheral circuits. The watch 200 and the wearable device 300 are signally connected to each other via the wireless communication unit 220 for data interchange (i.e., communication). The accelerometer 240 is also known as a gravity-sensor (G-sensor) that is able to detect three-dimensional acceleration. The storage unit 250 can be a storage medium such as a nonvolatile memory (e.g., flash memory) or a memory card (e.g., SD card).

Figure 3:
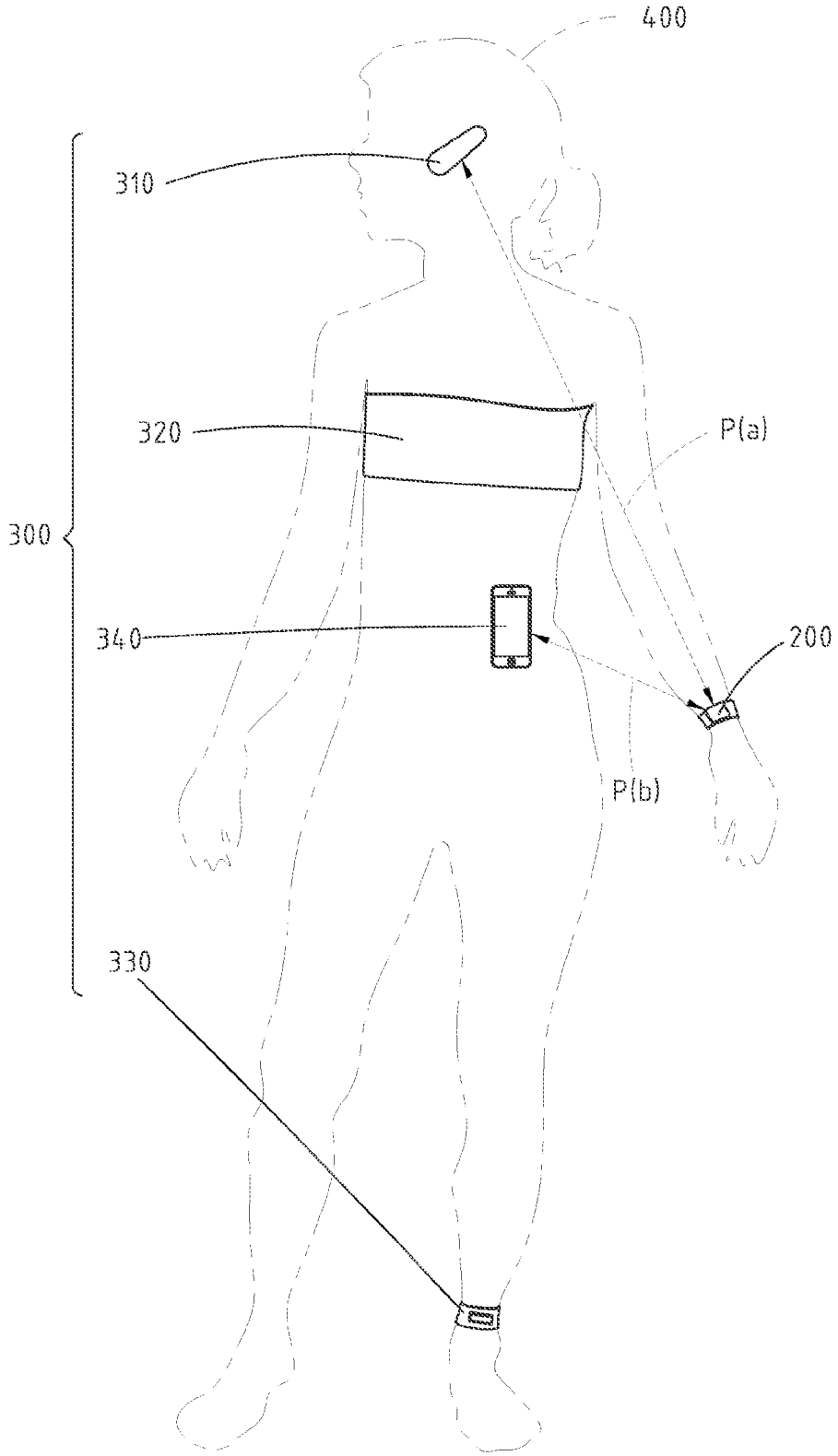
FIG. 3 illustrates a first diagram regarding the use of the watch and the wearable device according to an embodiment of the instant disclosure.
Figure 4:
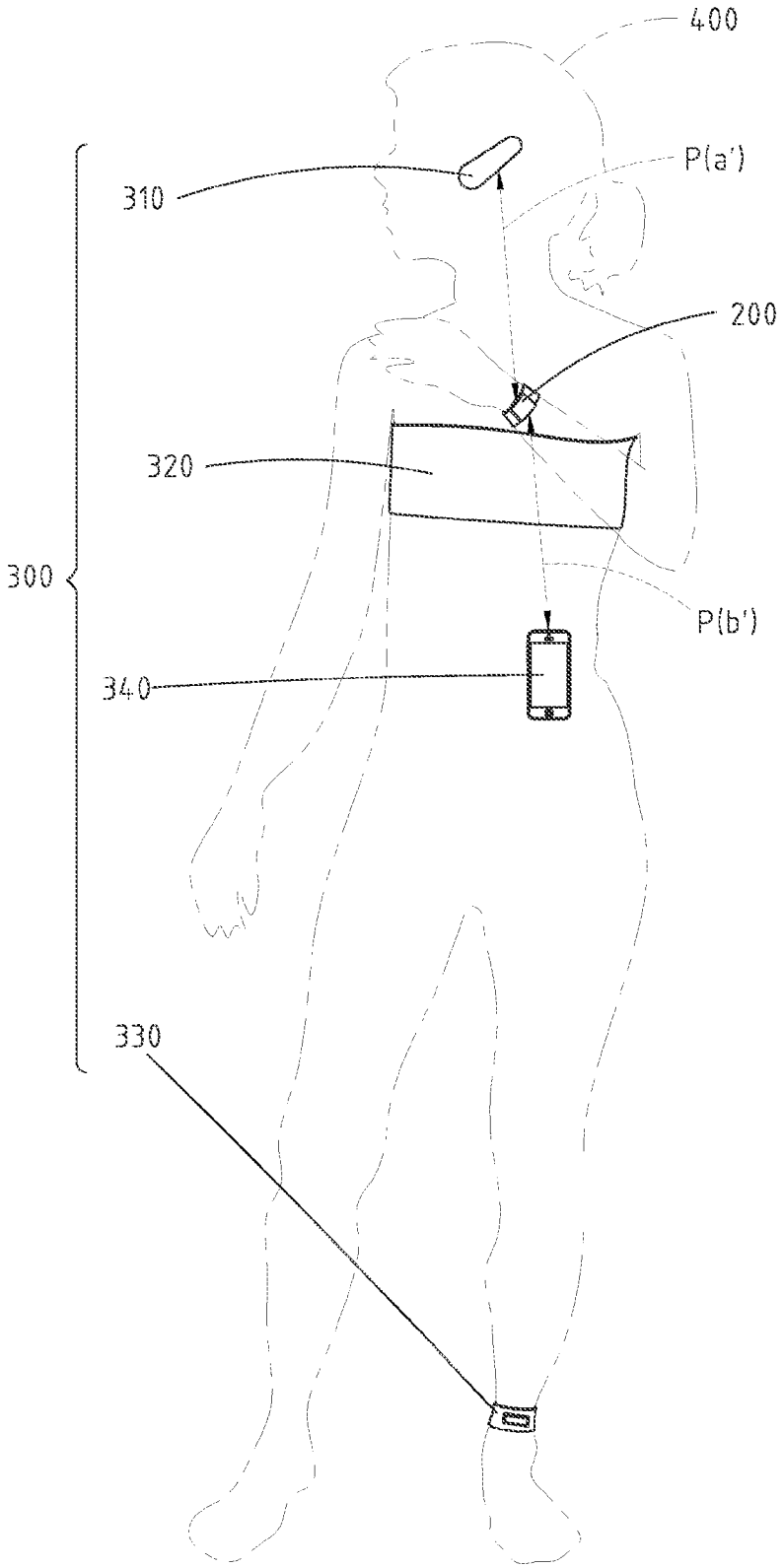
FIG. 4 illustrates a second diagram regarding the use of the watch and the wearable device according to an embodiment of the instant disclosure.

FIG. 3 and FIG. 4 respectively illustrate first and second diagrams regarding the use of the watch 200 and the wearable device 300 according to an embodiment of the instant disclosure. As shown in FIG. 3, the user 400 wears the watch 200 and at least a wearable device 300. The wearable device 300 includes, but is not limited to, a wireless earphone 310, a heart rate strap 320, a pedometer 330, or a cell phone 340. FIG. 4, comparing with FIG. 3, shows that the user 400 raises his/her arm to read the watch 200. Detailed description is given below.

Referring to FIG. 1, the step S120, after the step S110, is to establish a communication between the watch 200 and the wearable devices 300 via the wireless communication protocol. The communication protocols respectively between single watch 200 and several wearable devices 300 can be different. For example, the wireless earphone 310 can communicate with the watch 200 via ANT+, and the cell phone 340 can communicate with the watch 200 via Bluetooth. In the embodiment of the instant disclosure, however, the embodiment of the instant disclosure is not limited to the aforesaid example. Several wearable devices 300 can communicate with a single watch 200 via the same protocol, like Bluetooth.

Next, the step S130 is to measure a signal strength related to the communication. characteristic of wireless communication is that the shorter the distance between transmitting and receiving terminals is, the stronger the signal strength will be, and vice versa, meaning that the longer the distance is, the weaker the signal strength will be. The distance between the watch 200 and the wearable device 300 can be derived from measuring the signal strength related to the communication. The storage unit 250 stores predetermined signal strengths or predetermined distances respectively corresponding to the signal strength or distance between the wearable devices 300 and the watch 200. In the step S140, the controller 230 determines that the distance condition is satisfied when each of the signal strengths or each of the distances between the watch 200 and the wearable devices 300 satisfies (conforms to) the corresponding predetermined signal strengths or the corresponding predetermined distances. In some embodiments, the distance condition can be the predetermined signal strengths or the predetermined distances; therefore, the satisfaction of the distance condition is that all of the signal strengths or the distances between the watch 200 and the wearable devices 300 satisfy all of the corresponding predetermined signal strengths or the corresponding predetermined distances. For example, under the circumstance that three wearable devices 300 are in use, the distance condition is satisfied if the signal strengths respectively between the watch 200 and the three wearable devices 300 conform to the corresponding predetermined signal strengths. Another example is that three wearable devices 300 are in use, the distance condition can be satisfied if the signal strengths respectively between the watch 200 and two of the wearable devices 300 conform to the corresponding predetermined signal strengths or the distance between the watch 200 and the other wearable device 300 conforms to the corresponding predetermined distance. Referring to FIG. 3 and FIG. 4, the distances between the watch 200 and each of the wearable devices 300 vary along with the movement of the arm of the user 400. Therefore, whether the user 400 intends to read the watch 200 or not, it can be determined by the controller 230 in a manner of determining whether the distance condition is satisfied. The more wearable devices 300 the user 400 wears, the more precisely results the watch 200 determines.

Referring to FIG. 3, a signal strength between the watch 200 and the wireless earphone 310 is P(a), and a signal strength between the watch 200 and the cell phone 340 is P(b). At present shown in FIG. 3, although P(b) satisfies the corresponding distance condition, P(a) does not satisfy the corresponding distance condition; therefore, the backlight will not be turned on. When the user 400 raises his/her arm close to his/her chest, as shown in FIG. 4, the signal strength between the watch 200 and the wireless earphone 310 is P(a') and becomes better because of shorter distance. The signal strength between the watch 200 and the cell phone 340 is now P(b'). P(a') and P(b') all satisfy the distance condition in the embodiment shown in FIG. 4, and the backlight is thereby turned on. When the distance condition is satisfied, referring to the step S150, the controller 230 drives the backlight unit 210 to turn on the backlight.

Below is table 1.

| Distance (meter) | RSSI (dBm) | Distance (meter) | RSSI (dBm) |
|---|---|---|---|
| 0.00 | 0.00 | 3.60 | −26.50 |
| 0.30 | −4.50 | 3.90 | −27.40 |
| 0.60 | −10.00 | 4.20 | −28.40 |
| 0.90 | −15.00 | 4.50 | −28.00 |
| 1.20 | −20.00 | 4.80 | −28.00 |
| 1.50 | −20.50 | 5.10 | −27.00 |
| 1.80 | −26.50 | 5.40 | −29.00 |
| 2.10 | −26.50 | 5.70 | −28.00 |
| 2.40 | −27.00 | 6.00 | −28.50 |
| 2.70 | −28.00 | 6.30 | −29.50 |
| 3.00 | −28.50 | 6.60 | −30.50 |
| 3.30 | −27.50 | 6.90 | |

As shown in table 1, the shorter the distance is, the higher the RSSI is, and the longer the distance is, the lower the RSSI is. The variation between the RSSI and distance approaches to linear relation when the distance is particularly within 1.2 meters, meaning that the variation between the RSSI and distance for determination especially suit the application of the instant disclosure.

Figure 5:
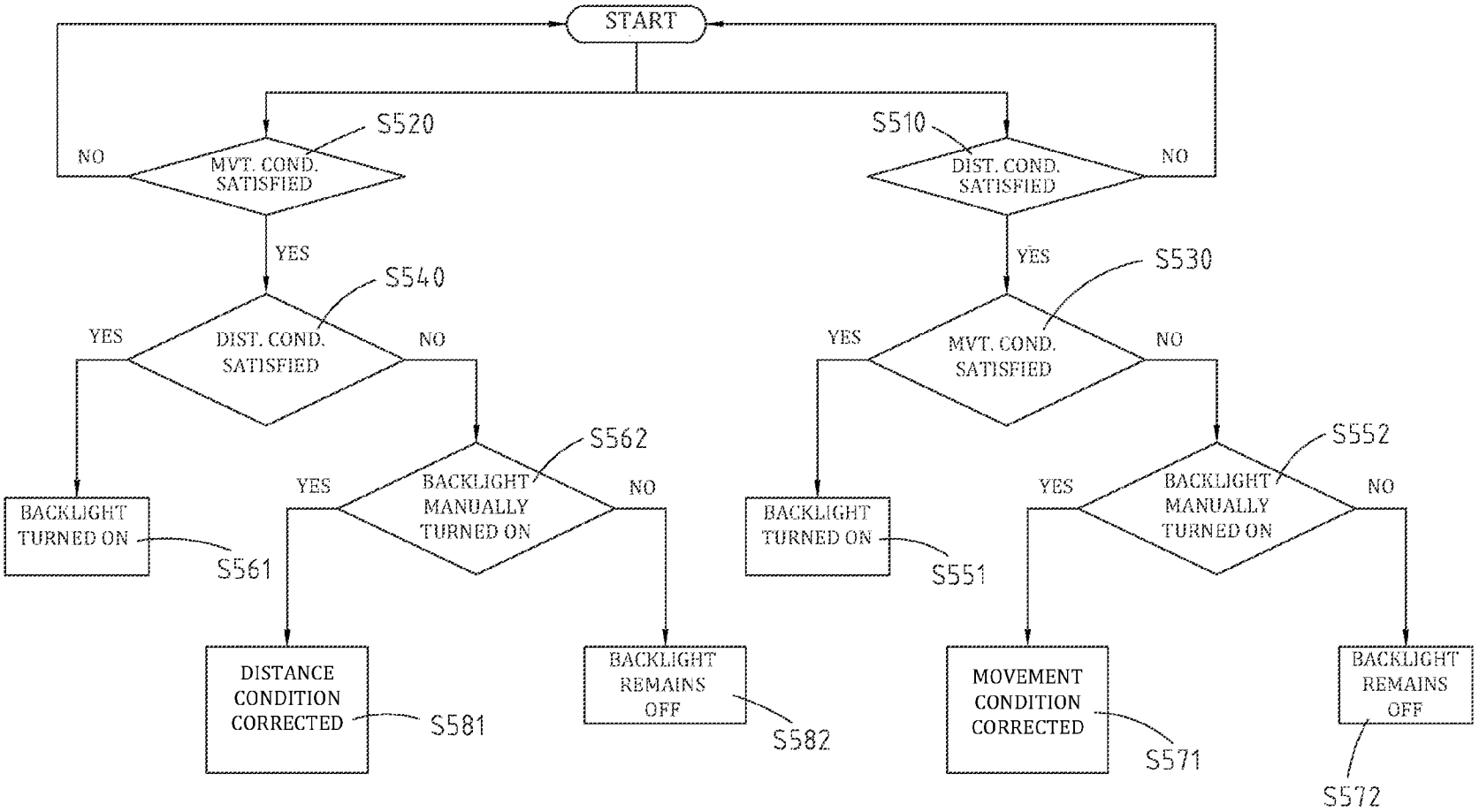
FIG. 5 illustrates a flow chart of a method of automatically turning on a backlight of a watch according to another embodiment of the instant disclosure.

FIG. 5 illustrates a flow chart of a method of automatically turning on a backlight of a watch according to another embodiment of the instant disclosure. As shown in FIG. 5, the controller 230 not only determines whether the aforementioned distance condition is satisfied (referring to the step S510), but also determines whether the movement condition is satisfied (referring to the step S520). Thus the movement condition is determined according to measurement data of the accelerometer 240. The movements of arm (e.g., raising or lowering) and the movements of wrist (e.g., turning over) can be detected based on the measurement data of the accelerometer 240. When the controller 230 determines that the user 400 is reading the watch 200 according to the measurement data of the accelerometer 240, the movement condition is satisfied. In some embodiments, the movement condition can be predetermined movement parameters of the watch 200 corresponding to the movement of arm and wrist, such as the acceleration, the angular acceleration, and the angular displacement of the watch 200. The storage unit 250 stores the predetermined movement parameters. The satisfaction of the movement condition means that the measurement data of the accelerometer 240 conform to the predetermined movement parameters.

If the controller 230 determines that the distance condition is satisfied in advance (referring to the step S510), next step (referring to the step S530) is that the controller 230 further determines whether the movement condition is satisfied. If both conditions are satisfied, the step S551 is executed. If the controller 230 determines that the movement condition is unsatisfied, next step (referring to the step S552) is that the controller 230 further determines whether the user 400 manually turns on the backlight within a predetermined time on himself. Manually turning on the backlight means that the user 400 intends to turn on the backlight. For example, the user 400 triggers a switch of the watch 200 for enforcing the backlight to be turned on. Namely, the backlight of the watch 200 is manually turned on by the user 400. If the controller 230 determines that the backlight is manually turned on by the user 400, next step (referring to the step S571) is to correct the movement condition according to the measurement data of the accelerometer 240 at that time. If not, the backlight remains off (referring to the step S572). Accordingly, the method includes a self-correcting capability such that the timing of automatically turning on the backlight by the watch 200 is closer to users' need.

Similarly, if the controller 230 determines that the movement condition is satisfied in advance (referring to the step S520), next step (referring to the step S540) is that the controller 230 further determines whether the distance condition is satisfied. If both conditions are satisfied, the step S561 is executed. If the controller 230 determines that the distance condition is unsatisfied, next step (referring to the step S562) is that the controller 230 further determines whether the user 400 manually turns on the backlight within the predetermined time on himself. If so, next step (referring to the step S581) is to correct the distance condition according to the signal strength or the distance at that time. If not, the backlight remains off (referring to the step S582). In conclusion, the distance condition will be corrected if the backlight is manually turned on by a user within the predetermined time under the circumstance that the movement condition is satisfied but the distance condition is unsatisfied. The movement condition will be corrected if the backlight is manually turned on by a user within the predetermined time under the circumstance that the distance condition is satisfied but the movement condition is unsatisfied.

In summary, according to the watch capable of automatically turning on the backlight and the related method, the backlight can be automatically and more precisely turned on when user want to read the watch so that power of the watch can be saved consequently. The timing of automatically turning on the backlight can be closer to users' need by the method of self-correcting and determining the conditions.

While the instant disclosure has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. A method of automatically turning on a backlight of a watch, comprising:

providing a watch and at least a wearable device both supporting a wireless communication protocol;

establishing a communication between the watch and the wearable device via the wireless communication protocol;

measuring a signal strength related to the communication;

determining whether a distance condition is satisfied based on the signal strength; and turning on a backlight of the watch when the distance condition is satisfied.

2. The method of automatically turning on a backlight of a watch of claim 1, wherein the watch determines whether to turn on the backlight further based on a movement condition, and the watch turns on the backlight when the distance condition and the movement condition are both satisfied.

3. The method of automatically turning on a backlight of a watch of claim 2, wherein the movement condition is related with measurement data of an accelerometer of the watch.

4. The method of automatically turning on a backlight of a watch of claim 2, further comprising:

determining, when one of the distance condition and movement condition is satisfied, whether or not the other one is satisfied and, if not, detecting whether the backlight of the watch is manually turned on within a predetermined time; and correcting the unsatisfied distance condition or the unsatisfied movement condition if the backlight of the watch is manually turned on within the predetermined time.

5. The method of automatically turning on a backlight of a watch of claim 4, wherein the distance condition is corrected if the distance condition is unsatisfied, or the movement condition is corrected if the movement condition is unsatisfied.

6. A watch capable of automatically turning on a backlight, comprising:

a backlight unit;

a wireless communication unit signally connected to at least a wearable device to establish a communication therebetween for measuring a signal strength related to the communication; and a controller coupled to the wireless communication unit and the backlight unit for determining whether a distance condition is satisfied based on the signal strength, wherein the backlight unit is turned on when the distance condition is satisfied.

7. The watch capable of automatically turning on a backlight of claim 6, further comprising an accelerometer coupled to the controller, wherein the controller determines whether a movement condition is satisfied based on measurement data of the accelerometer, and the backlight unit will be turned on if the movement condition and distance condition are both satisfied.

8. The watch capable of automatically turning on a backlight of claim 7, wherein when one of the distance condition and movement condition is satisfied, the controller determines whether the other one is satisfied, if not, the controller detects whether the backlight of the watch is manually turned on within a predetermined time, and, if so, the controller corrects the unsatisfied distance condition or the unsatisfied movement condition.

* * * * *